United States Patent [19]

Frederick

[11] 4,086,835

[45] May 2, 1978

[54] RESILIENT KNIFE GUIDE FOR CLOTH SPREADING MACHINE

[75] Inventor: Cecil S. Frederick, Murfreesboro, Tenn.

[73] Assignee: Cutters Machine Company, Inc., Nashville, Tenn.

[21] Appl. No.: 763,839

[22] Filed: Jan. 31, 1977

[51] Int. Cl.[2] ..... B65H 29/46

[52] U.S. Cl. ..... 83/484; 83/488; 83/508; 83/614; 270/30

[58] Field of Search ..... 83/484, 488, 508, 561, 83/614, 658, 925 CC; 270/30, 31

[56] References Cited

U.S. PATENT DOCUMENTS

| | | | |
|---|---|---|---|
| 2,065,380 | 12/1936 | Lamson | 83/614 X |
| 3,108,349 | 10/1963 | Takacs | 83/614 X |
| 3,233,488 | 2/1966 | Deichmann | 83/488 X |
| 3,506,254 | 4/1970 | Stumpf | 270/31 |

*Primary Examiner*—J. M. Meister

*Attorney, Agent, or Firm*—Harrington A. Lackey

[57] ABSTRACT

A transversely reciprocating cutting apparatus mounted on the frame of a cloth spreading machine to cut a cloth web spread by the machine, including a knife guide having an elongated transversely extending, highly frictional surface for holding a portion of the cloth web in place, while the knife of the cutting apparatus cooperates with the knife guide for cutting the cloth.

6 Claims, 6 Drawing Figures

RESILIENT KNIFE GUIDE FOR CLOTH SPREADING MACHINE

BACKGROUND OF THE INVENTION

This invention relates to a cutting apparatus for a cloth spreading machine, and more particularly to a knife guide mounted on the cloth spreading machine cooperating with the cutting apparatus.

Transversely reciprocable cutting apparatus for cutting webs of material, such as cloth, are known in the art as exemplified in the Castricum U.S. Pat. No. 1,730,560; and are known in combination with cloth spreading machines as exemplified in the Sayles U.S. Pat. Nos. 3,670,040 and 2,727,571; and in the Deichmann U.S. Pat. Nos. 3,094,319 and 3,233,488.

Although, in each of the Sayles and Deichmann patents the rotary disc blade is mounted to travel in a horizontal plane, that is the blade rotates about a vertical axis, to cut the vertically depending cloth, no practical and effective means is shown for firmly gripping and holding the cloth web in place as the rotary knife cooperates with the knife guide.

Furthermore, it is more difficult to cut stretchy or thin materials, such as tricot, "Qiana" and "Ultressa". Conventional means for applying tension to such thin materials are useless since the inherent resilience or "stretchiness" of the material neutralizes the applied tension. Consequently, the stretchy fabric must be cut in a free, floating, or relaxed condition.

The present method of cutting such stretchy mateial is with a transversely traveling, rotary knife, rotating at substantially higher R.P.M. than normal for cutting regular cloth. The increased speed of the rotary cutter is obtained by the introduction of additional gears in the transmission, which makes the cutting apparatus heavier and more expensive. Furthermore, the higher speed rotary knife is obviously more dangerous, requires more time in acceleration to top speed and deceleration to its stopped position, and is prone to excessive wear, damage, and down-time.

SUMMARY OF THE INVENTION

This invention relates to a cutting apparatus for a cloth spreading machine including a transversely reciprocable knife and an elongated transverse knife guide provided with novel means for gripping and holding the fabric while it is being cut.

The cutting apparatus or cloth spreading machine made in accordance with this invention, includes a knife blade, preferably a rotary knife blade mounted upon a cutter carriage and adapted to be reciprocably moved transversely of the frame of the cloth spreading machine. Cooperating with the knife blade is an elongated transversely mounted knife guide cooperating with the knife to contain the cloth web, being fed from the spreading machine to the surface of the cutting table, between the knife and the knife guide in order to facilitate transversely cutting the cloth web.

Specifically, the knife guide comprises a track formed of an upper and lower flange defining a transversely extending recess within which a portion of the rotary knife blade is adapted to travel. Received within the track recess is an elongated strip of highly frictional material, preferably soft and resilient, coinciding with the cutting path of the knife and extending laterally on opposite sides of the cutting path. As the knife travels transversely of the machine frame, the knife cuts its own kerf in the soft, highly frictional material. Thus, maximum areas of the highly frictional material will exist, not only on opposite sides of the knife, but in abutting relation with both sides of the knife, as the knife travels along the knife guide. The surface of the highly frictional material grips the portions of the cloth web on opposite sides of the cutting path, so that all portions of the cloth web adjacent the traveling knife blade are held in cutting position.

Because of the strip of highly frictional, soft material, the actual knife guide track recess need not be constructed to close tolerances relative to the cutting path of the knife, since the knife cuts its own kerf or channel within the frictional material.

The cutting apparatus made in accordance with this invention has been especially effective in cutting thin, stretchy materials, such as tricot, "Quiana" and "Ultressa".

DESCRIPTION OF THE PREFERRED EMBODIMENTS

Figure 1:
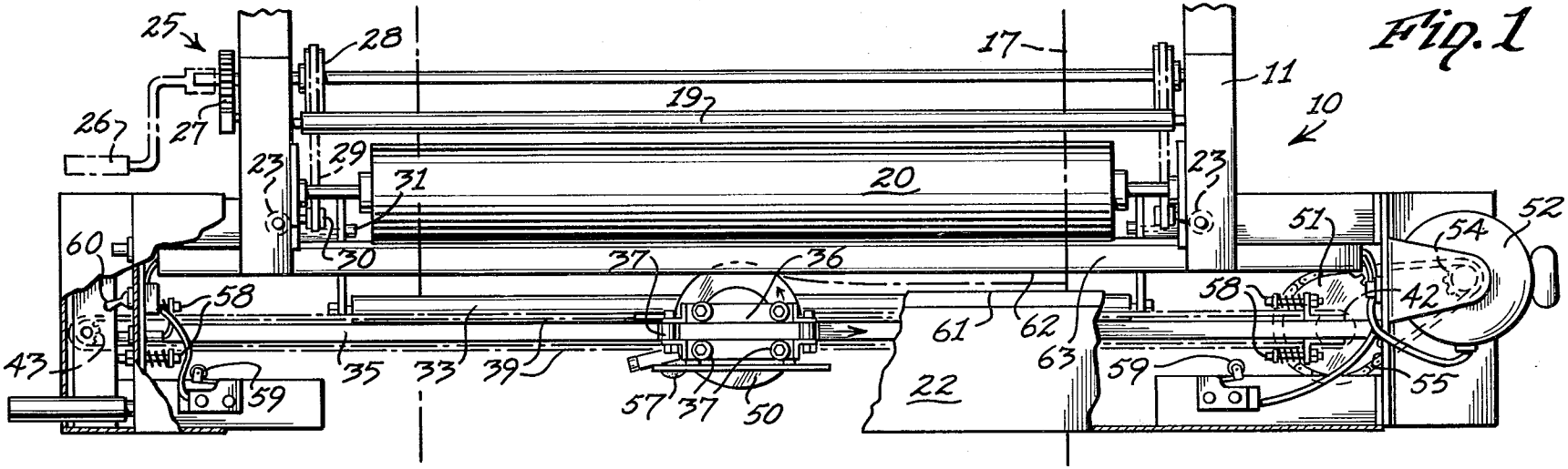
FIG. 1 is a fragmentary, top plan view of the front portion of a cloth spreading machine, with portions broken away to disclose the cutting apparatus.

Referring now to the drawings in more detail, the cloth spreading machine 10 includes a frame or machine frame 11 supported by smooth-surfaced wheels 12 on the remote side of the frame 11 running on the top surface of the cutting table 15, and grooved wheels on the proximal side of the machine frame 11 running along a track or rail 14 supported alongside the cutting table 15.

Figure 3:
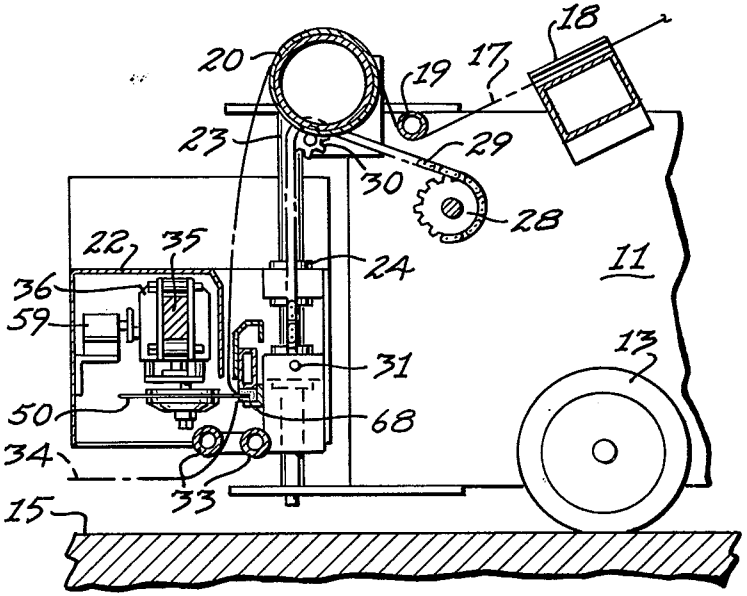
FIG. 3 is a fragmentary section taken along the line 3—3 of FIG. 2.

A cloth web 17, such as a web of stretchy fabric, is supplied from a source, such as a cloth supply roll, not shown, mounted upon the machine frame 11 and fed through an edge sensor 18, beneath a guide bar or guide roller 19, and then over a positively driven top feed roll 20, as best disclosed in FIG. 3.

Mounted upon one end of the spreader frame 11, which will be arbitrarily designated as the front end, is a combination spreading and cutter housing or frame 22. This housing 22 may be slidingly mounted upon vertical columns 23 by bearings 24 so that the housing 22 may be raised and lowered by a winch mechanism 25, including winch handle 26, gear train 27, winch sprocket 28, chain 29 and sprocket 30. The lower end of the chain 29 is fixed to the housing 22 by pin 31. Thus, the housing 22 may be raised as the cloth layers increase, by manual operation of the winch handle 26. A pawl, not shown, is employed to lock the winch mechanism 25 and hold the housing 22 in any desired elevated position.

Mounted in the bottom of the spreader housing 22 are a pair of spreader rollers 33, between which the cloth web 17 is fed by the feed roller 20 to spread the layers of cloth 34 upon the cutting table 15, as the frame 11 reciprocates longitudinally over the cutting table 15.

Mounted within the housing 22 to extend transversely the entire width of the spreading frame 11 is an elongated monorail 35 upon which is mounted the cutter carriage 36 by roller bearings 37 for reciprocable travel longitudinally over the monorail 35.

Figure 6:
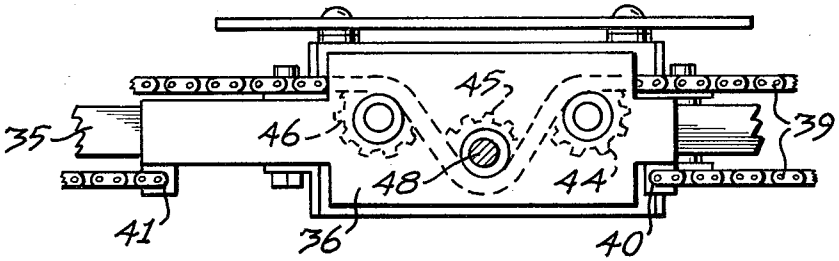
FIG. 6 is an enlarged, fragmentary section taken along the line 6—6 of FIG. 2.

The cutter carriage 36 is moved along the monorail 35 by a chain 39. Each end 40 and 41 of the chain 39 is fixed to opposite ends of the carriage 36 by any convenient connector means, as best disclosed in FIG. 6. The chain 39 is trained about a right sprocket 42 and a left sprocket 43 rotatably mounted at each end of the housing 22, while the middle portion of the chain 39 is trained about idler sprocket 44, blade sprocket 45 and idler sprocket 46 on the carriage 36. The blade sprocket 45 is fixed to the arbor or shaft 48 of the rotary knife blade 50, so that the knife blade 50 is rotated simultaneously with the movement of the carriage 36 along the monorail 39.

The right sprocket 42 is mounted on a common shaft with a larger driven sprocket 51, which is driven by electrical motor 52 through drive shaft 53, drive sprocket 54 and chain 55. The electrical motor 52 is mounted on the right end of the housing 22.

The rotary knife blade 50 may be provided with a knife sharpener device 57 (FIG. 2) fixed upon the cutter carriage 36 to sharpen the rotary knife 50 as the knife 50 rotates, and as the carriage 36 moves reciprocably along the monorail 35.

The ends of the housing 22 may be provided with bumpers 58 to absorb the kinetic energy of the cutter carriage 36 as it moves into either end of the housing 22.

Each end of the housing 22 is also provided with limit switches 59 in the path of the cutter carriage 36, as well as a manual start-stop switch 60, for conventional control of the motor 52 and the movement of the cutter carriage 36.

Figure 4:
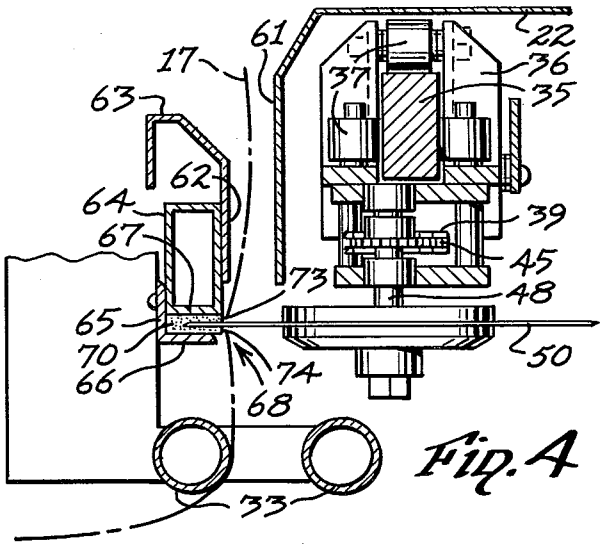
FIG. 4 is an enlarged fragmentary section taken along the line 4—4 of FIG. 2.

A cloth guide passage is defined by the rear wall 61 of the housing 22 and the front wall 62 of the transverse channel member 63 (FIG. 4). Thus, the rear housing wall 61 and the front channel wall 62 comprise, respectively, the front and rear parallel walls of the cloth passage.

Fixed to the rear surface of the cloth guide wall 62 is an elongated transverse tubular member 64. Fixed to the rear wall of the tubular support member 64 is an elongated angular member 65 forming a horizontal transverse bottom flange 66. The bottom flange 66 is spaced below and parallel to an upper flange 67, which forms the bottom portion of the tubular support member 64. These spaced flanges 66 and 67 define an elongated transverse knife guide 68 having an open transverse recess in which the cutting portion of the rotary knife 50 travels.

Snugly received within the recess between the upper and lower knife guide flanges 67 and 68 is an elongated strip of a soft, highly frictional material 70, preferably resilient, and also preferably made of a plastic foam material.

The top and bottom flanges 67 and 66 are spaced far enough away from the top and bottom surfaces of the intervening cutting portion of the rotary knife 50, that the knife will clear both flanges 66 and 67 without any frictional engagement with the flanges 66 and 67. The foam material strip 70 also assures that there will be no contact between the knife 50 and the flanges 66 and 67, because the rotary knife is designed to penetrate the foam material 70 and cut its own snugly fitting slot or kerf 71 longitudinally of the strip 70, throughout the length of the cutting path of the knife 50.

Another reason that the flanges 67 and 66 are spaced from both the top and bottom surfaces of the horizontal rotary knife 50 is that the strip of frictional material 70 will form an upper fabric gripping surface 73 and lower fabric gripping surface 74, respectively, above and below the kerf 71, or above and below the path of the knife 50. Thus, as the rotary knife 50 traverses the front of the machine frame 11, the leading cutting portion of the rotary knife 50 rotating toward the knife guide 68, will engage and pull the cloth web rearward into frictional engagement with the upper and lower frictional surfaces 73 and 74. These frictional foam surfaces 73 and 74 will hold the portion of the cloth 17 about to be cut, firmly in position as the knife 70 cuts through the cloth 17. Thus, there will be no wrinkling, bunching or gathering of the cloth prior to its being cut.

The cutting apparatus including the rotary knife 50, traversing carriage 36, and the knife guide 68, is particularly advantageous in the cutting of light, flimsy or stretchy material, such as tricot, "Quiana" and "Ultressa". The light, stretchy cloth web 17, although positively fed toward the spreading surface or cutting table 15 by the positively driven feed roll 20, nevertheless is fed between the walls 61 and 62 of the cloth passage, with very little, if any, tension in the web. Normally, it is difficult to transversely cut the loosely-hanging stretchy or filmy web 17, because of the absence of tension in the web, without using a rotary blade 50 which is rotating at an extremely high speed.

Accordingly, the cutting apparatus made in accordance with this invention may employ a rotary knife 50 which can be rotated at a slower speed because of the cloth gripping surfaces 73 and 74 of the highly frictional foam material 70.

Furthermore, lower tolerances are required in the spacing of the knife guide flanges 66 and 67, because of the soft resilient frictional material 70, into which the knife 50 cuts its own tightly fitting kerf 71.

Figure 2:
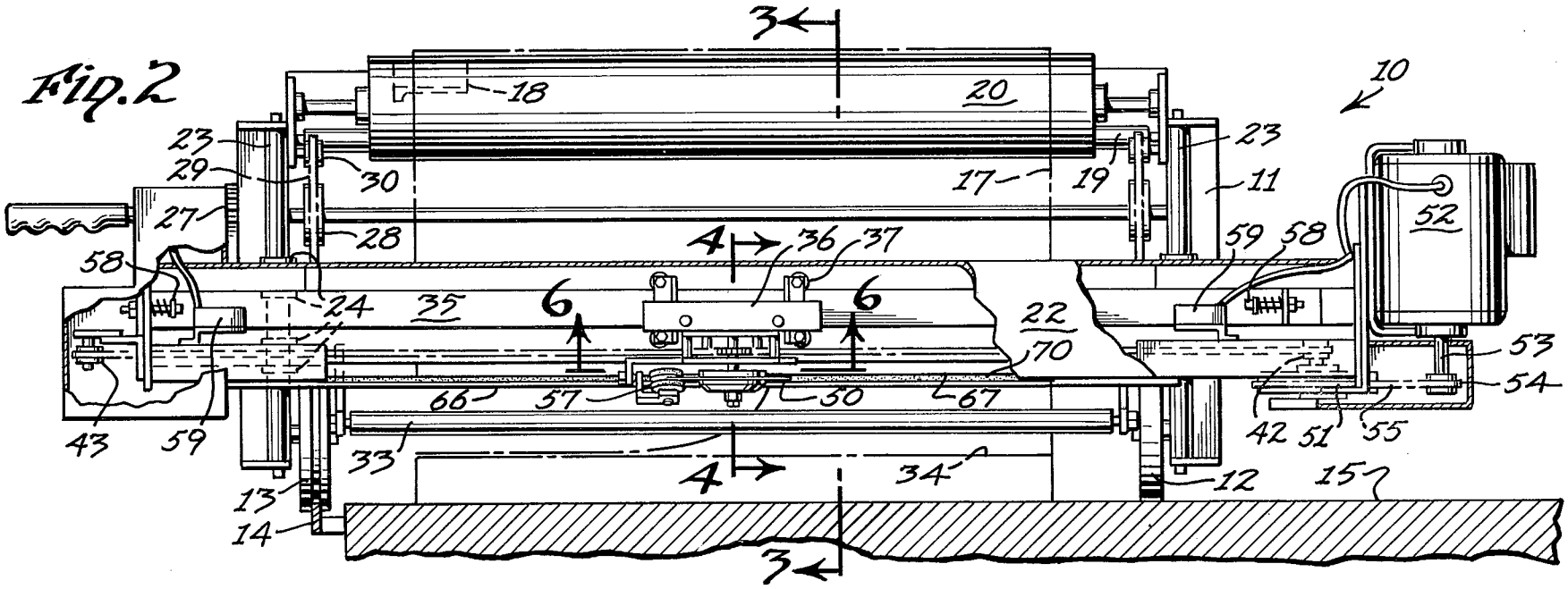
FIG. 2 is a fragmentary, front elevation of the machine disclosed in FIG. 1, with portions broken away.

In the operation of the cutting apparatus, the carriage 36 is normally carried in an inoperative position adjacent either the left or the right end of the carriage 22, but as disclosed in the drawings, it would normally start from the left end of the carriage 22, as viewed in FIGS. 1 and 2. After the spreading machine 10 has completed spreading a layer of the stretchy web material 17 upon the cloth layers 34, the machine 10 is stopped. The switch 60 is then turned on to start the electric motor 52, which drives the chain 39 to commence movement of the cutter carriage 36 toward the right. Simultaneously, because of the blade sprocket 45 cooperating with the chain 39, the knife 50 is simultaneously rotated in the direction of the arrows disclosed in FIGS. 1 and 5. As the leading edge of the knife blade 50 begins moving toward the web, the leading blade edge 50 engages and pulls the web 17 toward the knife guide 68, causing the portion of the web 17 to be cut to be firmly gripped by the upper and lower surfaces 73 and 74 of the foam frictional strip 70. Thus, the portion of the fabric web 17 immediately in advance of the cutting blade 50 is held in a firm, taut, cutting position straddling or spanning the kerf 71, just prior to being cut by the rotating knife blade 50. When the carriage 36 has reached the right end of the cutter housing 22, the fabric or cloth web 17 has been cut completely across its entire width along a substantially straight line, without wrinkling or bunching, tearing or ravelling. The carriage 36 may remain at the right side for the next cut from right-to-left, or the carriage 36 may be automatically returned to the left side preparatory to the next cut, depending upon the desire of the operator, or the programming of the cutter apparatus.

Figure 5:
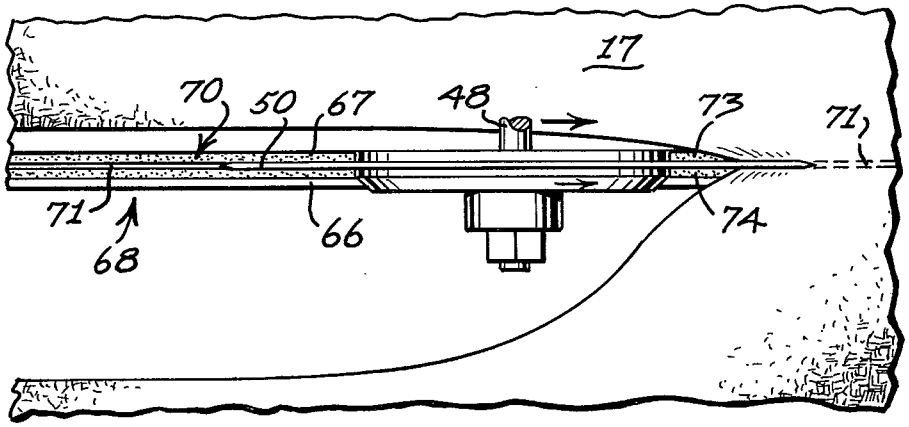
FIG. 5 is an enlarged, fragmentary, front elevation disclosing the rotary knife cooperating with the knife guide in operative position.

The pulling of the freely-hanging, stretchy cloth web 17 against the knife guide 58, by the rotary knife 50, is clearly disclosed in FIGS. 1, 4 and 5.

It will be further observed that the carriage 36 as well as the rotary knife 50, is driven solely by a sprocket and chain transmission, at a speed substantially reduced from the motor drive shaft 53, without any gearing or other transmission elements normally required for driving the knife 60 at a very high speed.

What is claimed is:

1. In a cloth spreading machine including a frame having a transverse dimension and adapted to travel in a longitudinal path along a table, and spreading means on the frame for spreading a web of cloth longitudinally upon the table, a cutting apparatus comprising:

(a) a knife blade having a cutting edge and first and second planar surfaces on opposite sides of said cutting edge, (b) means mounting said knife blade on said frame for operative cutting movement along a cutting path transversely of said frame, (c) an elongated knife guide mounted transversely on said frame for cooperation with said knife blade in said cutting path, (d) means on said frame suspending a portion of the cloth web to normally freely hang adjacent said cutting path when said knife blade is inoperative, (e) said knife guide comprising first and second parallel elongated cloth gripping surfaces of highly frictional material extending transversely of said frame and spaced apart on opposite sides of said cutting edge, said first gripping surface lying closely adjacent said first planar knife blade surface and said second gripping surface lying closely adjacent said second planar knife blade surface in operative cutting position to grip said suspended cloth web portion between said knife blade and said knife guide while said cloth web portion is being cut by said knife blade.

2. The invention according to claim 1 in which said highly frictional material is resilient.

3. The invention according to claim 1 in which said first and second gripping surfaces comprise an elongated strip of said highly frictional material coextensive with said cutting path, and extending laterally on opposite sides of said cutting path for limited distances, said highly frictional material being soft relative to said knife blade, so that said knife blade cuts its own kerf in said frictional material while cooperating with said knife guide.

4. The invention according to claim 1 further comprising means for moving said knife blade along said cutting path.

5. The invention according to claim 4 in which said knife blade is a rotary knife blade, said means mounting said knife blade on said frame comprising means mounting said knife blade for rotary movement about a substantially vertical rotary axis, and for simultaneous transverse movement along said cutting path, said rotary knife blade rotating in a direction to pull said cloth web portion against said gripping surfaces while said cloth web portion is being cut by said rotary knife blade.

6. The invention according to claim 1 in which said highly frictional material is plastic foam material.

* * * * *